US009425567B2

(12) United States Patent
Adelson et al.

(10) Patent No.: US 9,425,567 B2
(45) Date of Patent: Aug. 23, 2016

(54) ASSEMBLY FOR CONDUCTING ELECTRICAL POWER TO OR FROM ELECTRICALLY ACTIVE CEILING GRID

(71) Applicant: Nextek Power Systems, Inc., Detroit, MI (US)

(72) Inventors: Alex M. Adelson, Andes, NY (US); Paul Savage, Detroit, MI (US)

(73) Assignee: Nextek Power Systems, Inc., Detroit, MI (US)

( * ) Notice: Subject to any disclaimer, the term of this patent is extended or adjusted under 35 U.S.C. 154(b) by 0 days.

(21) Appl. No.: 14/587,379

(22) Filed: Dec. 31, 2014

(65) Prior Publication Data

US 2015/0280382 A1 Oct. 1, 2015

Related U.S. Application Data

(60) Provisional application No. 61/973,459, filed on Apr. 1, 2014.

(51) Int. Cl.
*H01R 25/14* (2006.01)

(52) U.S. Cl.
CPC ..... *H01R 25/142* (2013.01); *H01R 25/147* (2013.01)

(58) Field of Classification Search
USPC ..... 439/538, 121, 110, 652, 119
See application file for complete search history.

(56) References Cited

U.S. PATENT DOCUMENTS

| | | | | |
|---|---|---|---|---|
| 3,590,135 | A * | 6/1971 | Herbenar et al. | 174/491 |
| 5,158,472 | A * | 10/1992 | Juhlin | 439/215 |
| 6,059,582 | A * | 5/2000 | Tsai | 439/121 |
| 6,722,918 | B2 * | 4/2004 | McCoy | 439/533 |
| 7,351,075 | B1 * | 4/2008 | Patterson et al. | 439/121 |
| 7,762,821 | B2 * | 7/2010 | Patterson et al. | 439/121 |
| 7,997,910 | B2 * | 8/2011 | Myers et al. | 439/121 |
| 8,002,586 | B2 * | 8/2011 | Fleisig | 439/652 |
| 8,146,316 | B2 * | 4/2012 | Boss et al. | 52/506.07 |
| 8,506,310 | B2 | 8/2013 | Brandberg | |
| 8,535,070 | B2 | 9/2013 | Jacobs et al. | |
| 8,911,137 | B2 * | 12/2014 | Chien | 362/641 |
| 8,986,021 | B2 * | 3/2015 | Keswani | 439/110 |
| 2006/0276077 | A1 * | 12/2006 | Mori | 439/538 |
| 2007/0039755 | A1 * | 2/2007 | Mori et al. | 174/480 |
| 2007/0275594 | A1 * | 11/2007 | Greenberg | 439/501 |
| 2008/0090431 | A1 | 4/2008 | Patterson et al. | |
| 2009/0251127 | A1 * | 10/2009 | Kim | 324/76.11 |
| 2011/0300726 | A1 | 12/2011 | Myers et al. | |

* cited by examiner

*Primary Examiner* — Alexander Gilman
(74) *Attorney, Agent, or Firm* — Kirschstein, Israel, Schiffmiller & Pieroni, P.C.

(57) ABSTRACT

An assembly distributes electrical power between an electrically active grid element of a grid framework and an electrical device. The assembly includes a grid connector for making electrical contact with a pair of electrical conductors on the grid element, and an adapter mounted on the grid connector. The adapter includes an industry standard interface electrically connected to the grid connector. The interface is adapted to receive a power connector at one end of a power cable whose opposite end is connected to the electrical device.

6 Claims, 3 Drawing Sheets

ASSEMBLY FOR CONDUCTING ELECTRICAL POWER TO OR FROM ELECTRICALLY ACTIVE CEILING GRID

CROSS-REFERENCE TO RELATED APPLICATION

This application claims the priority of U.S. provisional patent application Ser. No. 61/973,459, filed Apr. 1, 2014, the entire contents of which are hereby incorporated herein by reference thereto.

FIELD OF THE DISCLOSURE

The present disclosure relates generally to an assembly for conducting electrical power to or from an electrically active ceiling grid, and, more particularly, to distributing low voltage direct current (DC) via one or more industry standard, electrical connectors or interfaces.

BACKGROUND

The electrical grid connecting America's power plants, transmission lines and substations to homes, businesses and factories operate almost entirely within the realm of high voltage alternating current (AC). Yet, an increasing fraction of electrical devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics, and virtually all products utilizing rechargeable or disposable batteries, such as smartphones, tablets, laptop computers, etc.

Installation of devices utilizing low DC voltage has been typically limited to locations in which a pair of wires is routed from a DC voltage source. Increased versatility in placement and powering of low DC voltage devices is desirable. Specifically, there is an increasing desire to have electrical functionality, such as DC power, in the interior building environment, and specifically in the ceiling environment, without the drawbacks of existing systems.

A conventional ceiling grid framework, such as one used in a surface covering system, includes main grid elements intersected by cross grid elements therebetween. The main and cross elements form a mutually orthogonal grid of polygonal openings into which devices or components, such as panels, light fixtures, speakers, motion detectors and the like can be inserted and supported. Known systems that provide electrification to devices, such as lighting components, in conventional framework systems utilize a means of routing discrete wires or cables, principally on an "as needed" point-to-point basis via conduits, cable trays and electrical junctions located in the space behind the ceiling grid framework. These known systems suffer from the drawback that the required network of wires occupy the limited space behind the ceiling grid framework and are difficult to service or reconfigure. Further, the electrical power levels that are typically available are not safe to work with for those not trained, licensed and/or certified.

It is known from U.S. Pat. No. 7,997,910 to provide an electrified ceiling grid framework system connected to a low DC voltage source. Each grid element in the system supports along its length a pair of electrical conductors or busses having opposing polarity and disposed on opposing surfaces of each grid element. An electrical grid connector or power tap is mounted on one or more of the grid elements and is electrically connected to the pair of conductors. A pair of wires extends from the grid connector to a remote electrical device for supplying low DC voltage directly to the device.

As advantageous as the known electrified ceiling grid framework systems have been, the techniques currently used are somewhat constrained in that the direct connection from the wires to the remote electrical device dictated the length of the wires. The wire length was thus customized for each device. If it was desired to connect to another device at a different location, then the wire length had to be changed. If a longer length was needed, then another set of wires had to be provided and hard-wired into the grid connector. In addition, the wires in the known systems were not reasonably accessible from all directions relative to the framework plane.

Accordingly, it would be desirable to enable the connection between the wires and the remote device to be more versatile, and to be more accessible.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
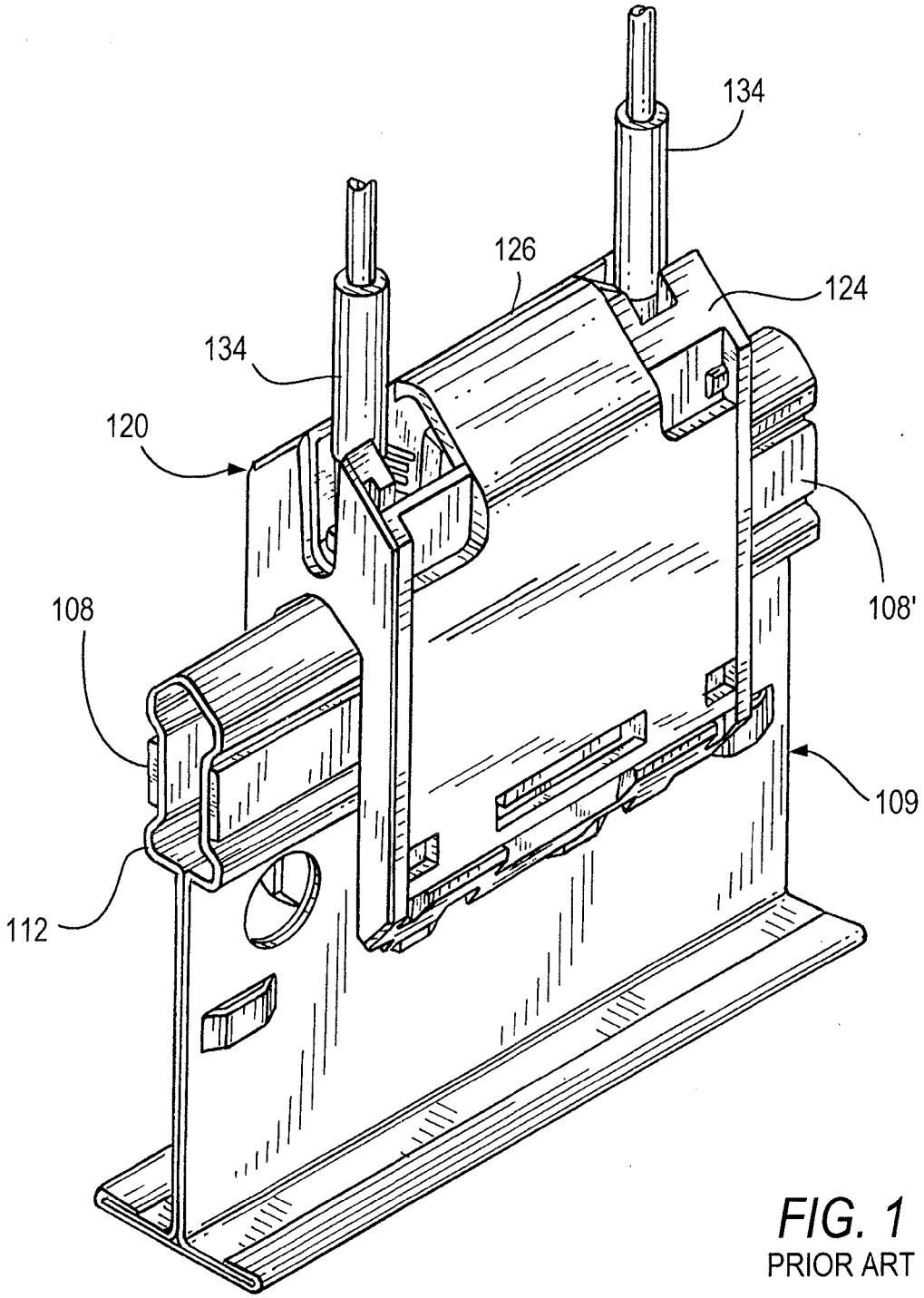
FIG. 1 PRIOR ART
FIG. 1 is a partially broken-away, perspective view of a grid element of an electrified ceiling grid framework system, assembled with a grid connector thereon, in accordance with the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The assembly components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

In accordance with one feature of this invention, an assembly distributes electrical power between an electrically active grid element of a grid framework and an electrical device. The assembly comprises a grid connector for making electrical contact with a pair of electrical conductors on the grid element, and an adapter mounted on the grid connector. The adapter includes an industry standard interface electrically connected to the grid connector. The interface is adapted to receive a power connector at one end of a power cable whose opposite end is connected to the electrical device. If the electrical device is a DC power supply, then the assembly supplies DC voltage to the grid element. If the electrical device consumes DC power, then the assembly supplies DC voltage to the electrical device. One suitable interface is the Universal Serial Bus (USB) protocol, Versions 1.0, 2.0, or 3.0. Types of USB interfaces or connectors include: Standard-A plug/receptacle, Standard-B plug/receptacle, Micro-A or -B plug/receptacle, and Mini-A or -B plug/receptacle.

Turning now to the drawings, reference numeral 109 generally identifies a representative grid element of an electrified grid framework that supports a suspended ceiling. Any system having a framework of mutually orthogonal grid elements can utilize the technology of the invention. The framework may support decorative tiles, acoustical tiles, insulative tiles, other ceiling elements, covers, or combinations thereof, or any electrical device that consumes electricity, such as lights, heating ventilation and air conditioning (HVAC) vents, or any electrical device that supplies electricity, such as a power supply. A pair of conductors or busses, such as flattened strips 108 and 108' of positive and negative DC voltage polarity, are disposed on the grid element 109, and specifically, on a top portion 112 thereof. A voltage power supply (not illustrated) is connected to the strips 108 and 108' to render them electrically active with any desired voltage.

An electrical grid connector 120 provides a means for bringing DC power to the strips 108 and 108' from the power supply, or from the strips 108 and 108' to various low DC voltage electrically consuming devices. Those devices include, but are not limited to, digital displays, remote controls, touch-sensitive controls, transmitters, receivers, timers, light emitting diodes (LEDs), audio amplifiers, microprocessors, other digital electronics, and virtually all products utilizing rechargeable or disposable batteries, such as smartphones, tablets, laptop computers, etc. Low voltage devices, such as light emitting diode (LED) lights, speakers, smoke or carbon monoxide detectors, wireless access points, still or video cameras, or other low voltage devices, may also be powered by, and mounted on, the electrified grid framework.

Figure 2:
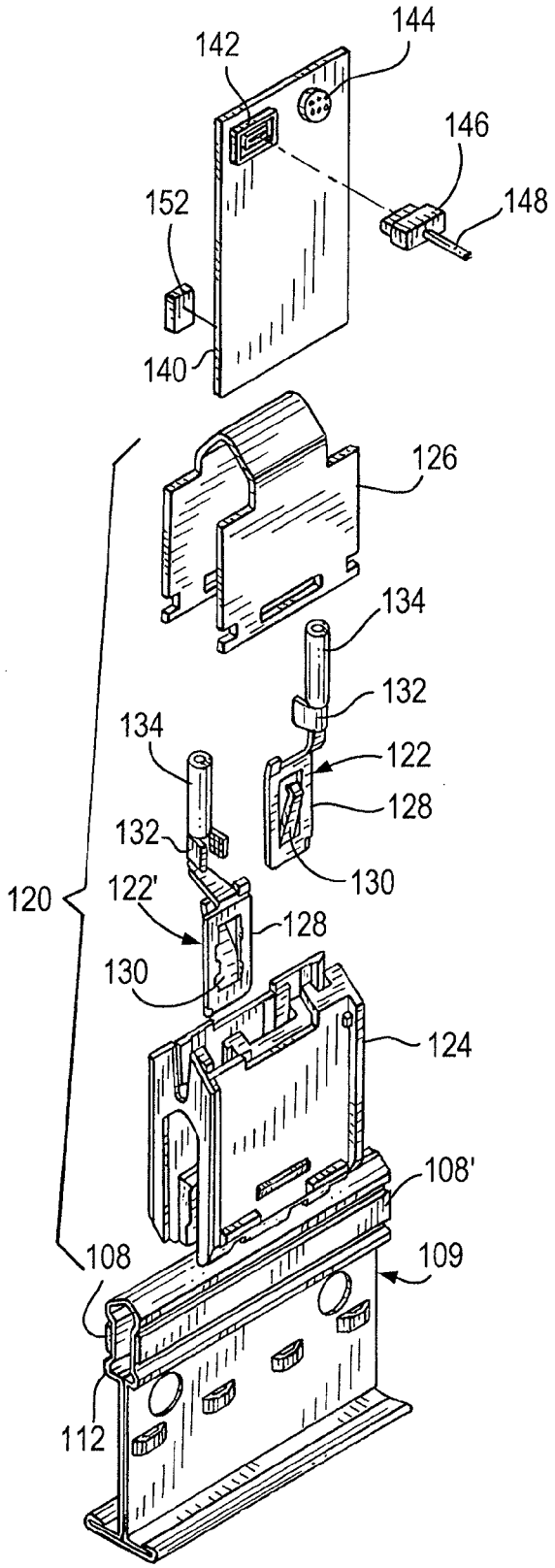
FIG. 2 is an exploded perspective view of the assembly of FIG. 1, together with an added adapter in accordance with this disclosure.

As best seen in FIG. 2, the grid connector 120 includes two conductive wire crimp contacts 122 and 122', a non-conductive insulative housing 124, and an outer clamp 126. Each conductive wire crimp contact 122 and 122' includes first and second contacting portions. The first contacting portion 128 of each wire crimp contact 122 and 122' includes a contact spring 130 which is resilient and, upon installation, is brought into contact with, i.e., taps, the strips 108 and 108' disposed on the grid element 109. The second contacting portion 132 of each crimp contact 122 and 122' is also in contact with the strips 108 and 108'. The second contacting portion of each crimp contact 122 and 122' is a receptacle 132, which is attachable to wires 134 that transport the low DC voltage either to, or away from, the grid connector 120.

The insulative housing 124 is flexible and U-shaped, and is mounted to the grid element 109 over the top portion 112. The housing 124 accepts, i.e., houses, the wire crimp contacts 122 and 122' and aligns the contacts into the proper position so as to mate each with strips 108 and 108'. When the grid connector 120 is mounted onto the grid element 109, each of the first contacting portions of the wire crimp contacts is aligned with the strips 108 and 108'. As the wire crimp contacts are mounted to an interior wall of the insulative housing 124, the insulative housing essentially provides isolation of the wire crimp contacts from one another, which, in turn, prevents the wire crimp contacts from shorting with each other.

The outer clamp 126 is made of rigid, yet somewhat compliant material, and snaps over the insulative housing 124. Although the clamp 126 can be installed, or even pre-assembled, on the housing 124 prior to attaching the grid connector 120 to the grid element 109, the clamp 126 can be installed in at least two other ways to minimize insertion forces. First, the clamp 126 can be installed after fully seating the housing 124 on the grid element 109 to provide for low insertion forces. Alternatively, the clamp 126 can be partially installed on the housing 124 in an up position and then fully seated after the housing 124 is in the fully mated position, which also provides low insertion forces, but requires the clamp 126 to be pre-assembled on the housing 124.

This firm, yet compliant, clamp 126 provides strength to this otherwise flexible U-shaped housing 124 to assure a tight and electrically sound electromechanical connection to the strips 108, 108'. The clamp 126 also assists in assuring that the connection is sufficiently strong to prevent it from being dislodged from the grid element 109 upon entry and/or removal of devices, such as ceiling tiles or electrical devices. In addition, an optional sloping surface of the top portion of the clamp 126 provides ease of entry for devices such as ceiling tiles when the connector 120 interferes with the insertion of the device into the openings formed by the grid framework. Similarly, the bottom, or perch, end of the housing 124 has a sloping surface to assist in removal of devices without causing accidental dislodging of the connector 120.

As described above, in the prior art, the direct connection from the wires 134 to the remote electrical device dictated the length of the wires 134. The wire length was thus customized for each device. If it was desired to connect to another device at a different location, then the wire length had to be changed. If a longer length was needed, then another set of wires had to be provided and hard-wired into the connector. In addition, the wires 134 in the known systems were not reasonably accessible from all directions relative to the framework plane.

Figure 4:
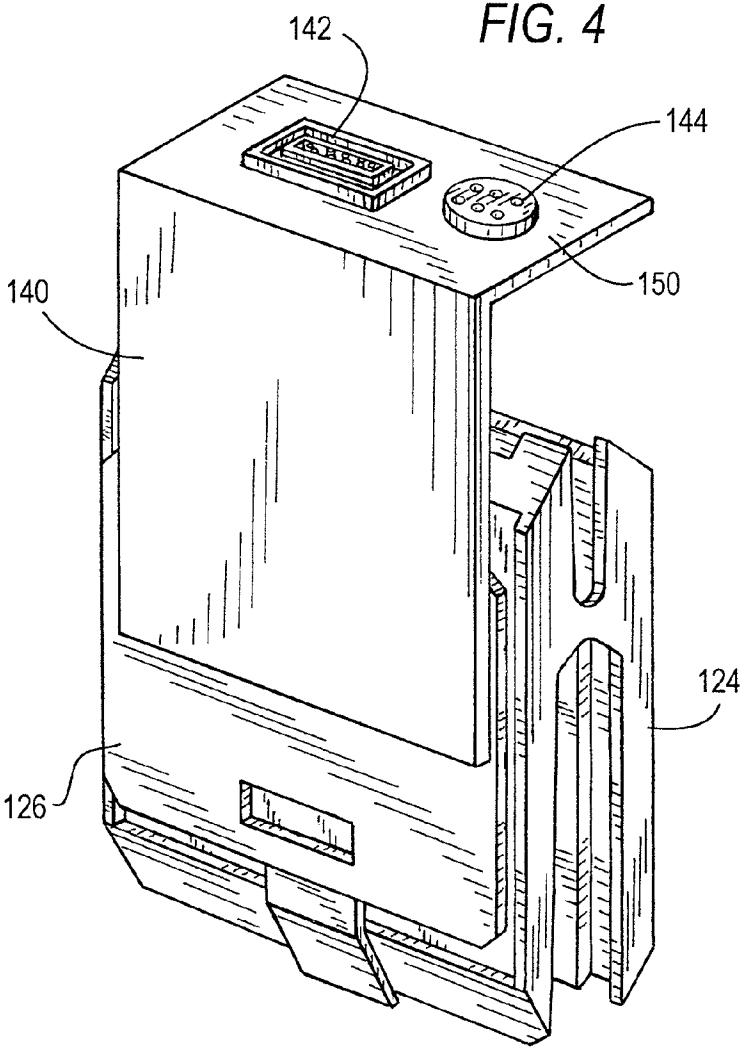
FIG. 4 is a view analogous to FIG. 3, but of a different embodiment.
Figure 3:
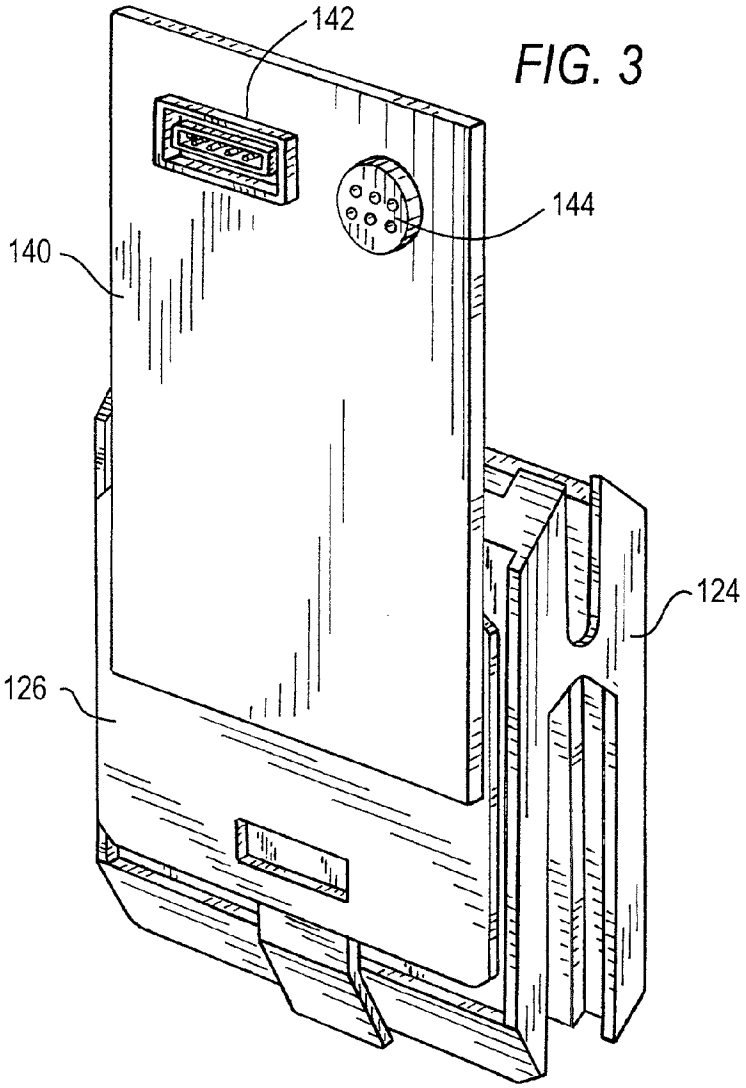
FIG. 3 is an enlarged, front perspective view of the adapter of FIG. 2 mounted on the grid connector of FIG. 2.

Hence, in accordance with this disclosure, an adapter is mounted on the grid connector 120. The adapter includes a support plate 140 that is fixed to the clamp 126, and at least one industry standard interface or bidirectional connector mounted on the plate 140 and electrically connected to the grid connector 120 via the wires 134. As illustrated in FIGS. 2-4, the industry standard interface is preferably the Universal Serial Bus (USB) protocol, Versions 1.0, 2.0, or 3.0. Types of USB interfaces or connectors include: Standard-A plug/receptacle, Standard-B plug/receptacle, Micro-A or -B plug/receptacle, and Mini-A or -B plug/receptacle. A USB 2.0 Standard-A type of USB receptacle 142 is illustrated and has a generally rectangular socket. This receptacle 142 is frequently seen on a computer to which computer peripherals, such as a keyboard, a mouse, or a flash drive, are connected by a USB plug, such as plug 146, at the end of a power cable 148 in FIG. 2. The USB receptacle has multiple pins, two of which, typically pins 1 and 4, are the power pins that are connected to the wires 134.

Another receptacle 144 is optionally mounted on the plate 140 and illustrates a generic, industry standard, bidirectional connector. In FIG. 4, the plate 140 is non-planar so that the receptacles 142, 144 are located on a bent portion 150 and face upwardly, in contrast to FIG. 3 where the receptacles 142, 144 face off to the side. The bent portion 150 can also be hinged to the plate 140 for even greater versatility in orienting the receptacles.

Once the adapter and the grid connector 120 are mounted on a grid element 109, the USB plug 146 of the power cable 148 may be readily inserted into the receptacle 142. If the opposite end of the power cable 148 is connected to a DC power supply, then the assembly supplies DC voltage at any desired value to the grid element 109. If the opposite end of the power cable 148 is connected to an electrical device that consumes DC power, then the assembly supplies DC voltage to the electrical device. Power cables of different lengths may be provided to simplify the connections. In addition, the different orientations of the receptacles 142, 144 in FIGS. 3-4 renders them reasonably accessible from all directions relative to the framework plane.

The support plate 140 may also conveniently support one or more circuit boards and/or one or more electrical components, such as a voltage regulator 152 (see FIG. 2) to insure that the low voltage does not exceed certain limits. For example, it is preferred that the low DC voltage not exceed 24 VDC at 100 watts, and the regulator configured, for example, by a zener diode and a resistor, can insure that such a limit will not be exceeded. The voltage regulator 152 may also include a current limiter for limiting the electrical current to any desired value.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An assembly for distributing electrical DC power to and from an electrical device, comprising:

a grid framework having at least one elongated grid element;

a pair of electrical DC conductors on, and extending along, the at least one grid element;

a grid connector mounted on the at least one grid element, the grid connector having a pair of electrical contacts for making electrical contact with the electrical DC conductors on the at least one grid element, and a pair of electrical wires connected to, and extending away from, the electrical contacts;

a support mounted on, and extending away from, the grid connector;

a plurality of electrical DC connectors each individually mounted on the support above the grid connector, each electrical DC connector being connected to the electrical wires and being configured to electrically connect to a DC power connector at one end of a DC power cable whose opposite end is connected to the electrical device; and a DC voltage regulator mounted on the support for limiting DC voltage at each DC connector.

2. The assembly of claim 1, wherein the framework lies in a generally horizontal framework plane, and wherein the support is a generally planar plate that extends generally perpendicular to the framework plane, and wherein each electrical DC connector is mounted on the plate.

3. The assembly of claim 1, wherein the framework lies in a generally horizontal framework plane, and wherein the support includes a generally planar, upright support portion that extends generally perpendicular to the framework plane, and a generally planar, upper support portion that extends generally parallel to the framework plane, and wherein each electrical DC connector is mounted on the upper support portion.

4. The assembly of claim 1, wherein one of the electrical connectors is a Universal Serial Bus (USB) connector.

5. The assembly of claim 1, wherein the DC power cable conveys the electrical DC power from the electrical device to the pair of electrical conductors on the at least one grid element.

6. The assembly of claim 1, wherein the DC power cable conveys the electrical DC power from the pair of electrical conductors on the at least one grid element to the electrical device.

* * * * *